US011172721B2

(12) United States Patent
Cecchi et al.

(10) Patent No.: US 11,172,721 B2
(45) Date of Patent: Nov. 16, 2021

(54) PROTECTIVE SPORTS HEADGEAR

(71) Applicant: Counter, Inc., Anaheim, CA (US)

(72) Inventors: Nicholas James Cecchi, Anaheim, CA (US); Theophil Jonathan Oros, Villa Park, CA (US)

(73) Assignee: Counter, Inc., Anaheim, CA (US)

( * ) Notice: Subject to any disclaimer, the term of this patent is extended or adjusted under 35 U.S.C. 154(b) by 42 days.

(21) Appl. No.: 16/045,489

(22) Filed: Jul. 25, 2018

(65) Prior Publication Data

US 2019/0029354 A1 Jan. 31, 2019

Related U.S. Application Data

(60) Provisional application No. 62/537,573, filed on Jul. 27, 2017, provisional application No. 62/646,261, filed on Mar. 21, 2018.

(51) Int. Cl.

| | |
|---|---|
| ***A42B 3/12*** | (2006.01) |
| ***A42B 1/08*** | (2006.01) |
| ***A42B 1/12*** | (2006.01) |
| ***A42B 3/06*** | (2006.01) |
| ***A42B 3/16*** | (2006.01) |
| ***A42B 3/20*** | (2006.01) |

(Continued)

(52) U.S. Cl.

CPC ..... *A42B 3/125* (2013.01); *A42B 1/08* (2013.01); *A42B 1/12* (2013.01); *A42B 3/069* (2013.01); *A42B 3/16* (2013.01); *A42B 3/20* (2013.01); *A42B 7/00* (2013.01); *A42C 2/00* (2013.01); *A63B 33/00* (2013.01); *A42B 3/185* (2013.01)

(58) Field of Classification Search

CPC .. A42B 1/08; A42B 3/069; A42B 3/32; A42B 3/324; A42B 3/125; A42B 1/12; A42B 3/16; A42B 3/20; A42B 7/00; A42B 3/185; A42C 2/00; A63B 33/00

See application file for complete search history.

(56) References Cited

U.S. PATENT DOCUMENTS

| | | | |
|---|---|---|---|
| 1,531,394 | A | 3/1925 | Hart |
| 3,454,962 | A | 7/1969 | Hind |

(Continued)

FOREIGN PATENT DOCUMENTS

| | | |
|---|---|---|
| EP | 0 056 883 B1 | 6/1985 |
| WO | WO 2012/164299 A1 | 12/2012 |
| WO | WO 2017/055167 A1 | 4/2017 |

OTHER PUBLICATIONS

PCT, International Search Report and Written Opinion, dated Dec. 10, 2018, PCT/US 18/43475.

*Primary Examiner* — Katherine M Moran
*Assistant Examiner* — Erick I Lopez
(74) *Attorney, Agent, or Firm* — Knobbe Martens Olson & Bear LLP

(57) ABSTRACT

The disclosure relates to a protective sports headgear device and method for manufacturing a protective sports headgear device. The device may include various padding materials that can reduce the risk of head injury for the wearer. One or more external covering layers can be connected to the padding or can surround and retain the padding. The protective sports headgear device may provide protection for the ears of the wearer as well. Additionally, the protective sports headgear device can be suitable for use in the sports of water polo, wrestling, or other sports.

17 Claims, 11 Drawing Sheets

(51) Int. Cl.

| | |
|---|---|
| ***A42B 3/32*** | (2006.01) |
| ***A42C 2/00*** | (2006.01) |
| ***A63B 33/00*** | (2006.01) |
| ***A42B 3/18*** | (2006.01) |
| ***A42B 7/00*** | (2006.01) |

(56) References Cited

U.S. PATENT DOCUMENTS

| | | | | |
|---|---|---|---|---|
| 3,789,427 | A | 2/1974 | Aileo | |
| 4,134,155 | A | 1/1979 | Robertson | |
| 4,307,471 | A | 12/1981 | Lovell | |
| 5,544,367 | A | 8/1996 | March | |
| 5,855,026 | A * | 1/1999 | Viola | A42B 1/12 2/428 |
| 5,930,841 | A * | 8/1999 | Lampe | A42B 3/00 2/411 |
| 6,389,607 | B1 | 5/2002 | Wood | |
| 7,062,795 | B2 | 6/2006 | Skiba et al. | |
| 7,937,778 | B1 * | 5/2011 | Norton | A42B 1/08 2/175.4 |
| 8,613,114 | B1 * | 12/2013 | Velasco | A42B 3/125 2/411 |
| 8,997,265 | B2 | 4/2015 | Olivares Velasco | |
| D733,973 | S | 7/2015 | Larocque | |
| 9,693,594 | B1 | 7/2017 | Castro et al. | |
| 2004/0250340 | A1 | 12/2004 | Piper et al. | |
| 2005/0015855 | A1 * | 1/2005 | Skiba | A42B 3/12 2/412 |
| 2008/0068556 | A1 | 3/2008 | Harrison | |
| 2009/0056000 | A1 * | 3/2009 | de Taboada | G02C 3/02 2/422 |
| 2009/0144885 | A1 * | 6/2009 | Mix | A63B 33/00 2/421 |
| 2012/0047635 | A1 * | 3/2012 | Finiel | A42B 3/125 2/414 |
| 2012/0233746 | A1 * | 9/2012 | Jwa | A42B 3/00 2/414 |
| 2014/0007324 | A1 * | 1/2014 | Svehaug | A42B 1/08 2/412 |
| 2014/0196198 | A1 * | 7/2014 | Cohen | F41H 1/04 2/414 |
| 2014/0237706 | A1 * | 8/2014 | O'Conner | A42B 1/08 2/410 |
| 2015/0040296 | A1 * | 2/2015 | Hanson | A42B 3/069 2/411 |
| 2015/0157077 | A1 * | 6/2015 | Stricker, Jr. | A42B 1/12 2/414 |
| 2016/0021960 | A1 * | 1/2016 | Lacy | A42B 1/247 2/175.5 |
| 2016/0353823 | A1 * | 12/2016 | Buri | A42B 1/068 |
| 2017/0119077 | A1 * | 5/2017 | Purviance | A42B 1/22 |

* cited by examiner

PROTECTIVE SPORTS HEADGEAR

CROSS-REFERENCE TO RELATED APPLICATIONS

This application claims priority benefit under 35 USC § 119(e) of U.S. Provisional Patent Application Ser. No. 62/537,573 filed Jul. 27, 2017 and U.S. Provisional Patent Application Ser. No. 62/646,261 filed Mar. 21, 2018, the contents of which are hereby incorporated by reference in their entirety.

BACKGROUND OF THE INVENTION

Field of the Invention

Embodiments of the invention are generally related to devices for protecting the wearer's head from impact and protecting others from the wearer's head. Embodiments are capable of being used for many different sporting activities, including those that take place in or out of the water.

Description of the Related Art

Although various types of protective sports headgear are known, there remains a need for improved protective sports headgear. Concussions and other head injuries are problematic in a multitude of sports. Additionally, there are many sports where it is not practical for one to wear a bulky or heavy helmet.

In the sport of water polo, the headgear that is traditionally worn by players provides very little to no protection for the wearer. Water polo is a contact sport, and concussions and head injuries occur with some frequency. Additionally, the traditional headgear is not buoyant and may sink to the bottom of the pool where a water polo match is being played if it is knocked loose.

SUMMARY OF THE INVENTION

The systems, methods and devices of the disclosure each have several innovative aspects, no single one of which is solely responsible for the desirable attributes disclosed herein.

According to one embodiment, a protective sports headgear device includes: an inner layer of material which includes a first side which contacts a wearer's head and a second side which contacts at least one layer of padding material; an outer layer of material has an internal side which contacts the at least one layer of padding material and an external side that provided the outer surface of the headgear device; and an edge seals the inner layer to the outer layer so they are joined together such that the at least one layer of padding material is retained within the inner layer and outer layer material.

According to one embodiment, a protective sports headgear device includes at least one layer of covering material and at least one layer of padding material wherein the at least one layer of padding material is composed of a plurality of panels, wherein each panel is connected to at least one other panel.

According to one embodiment, a protective sports headgear device includes at least one layer of covering material and at least one layer of padding material, wherein the covering material is configured to substantially surround at least one of the larger faces of the padding material, and wherein both the padding material and the covering material are configured to substantially cover a human head when in use.

According to one embodiment, a method is provided for manufacturing a protective sports headgear device. The method includes providing a padding material formed from a plurality of individual padding panels that are affixed to one another; providing an inner covering material and an outer covering material, where each of the covering materials have edges, combining the inner covering material, the padding material and the outer covering material together; and joining the edges of the inner covering material and the edges of the outer covering material such that the padding material is retained between layers of inner covering material and outer covering material.

BRIEF DESCRIPTION OF THE DRAWINGS

These figures are provided for illustrative purposes and the embodiments are not limited to the specific implementations illustrated in the figures.

DETAILED DESCRIPTION

Figure 1:
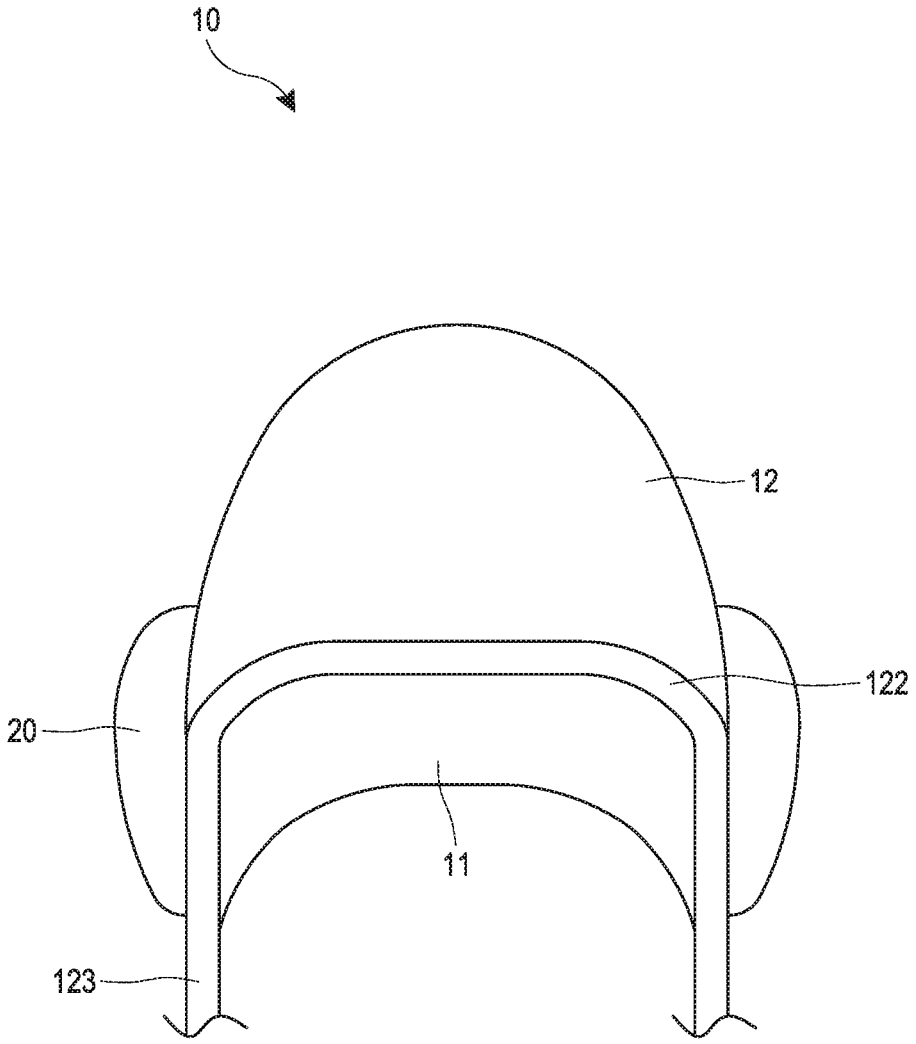
FIG. 1 shows a front perspective view of one embodiment of a protective sports headgear device.

Any feature or combination of features described herein are included within the scope of the present disclosure provided that the features included in any such combination are not mutually inconsistent as will be apparent from the context, this description, and the knowledge of one skilled in the art. In addition, any feature or combination of features may be specifically excluded from any embodiment of the present disclosure. For purposes of summarizing the present disclosure, certain aspects, advantages, and novel features of the present disclosure are described herein. Of course, not necessarily all such aspects, advantages, or features will be present in any particular embodiment of the present disclosure.

Embodiments presented herein are by way of example and not by way of limitation. The intent of the following detailed description, although discussing exemplary embodiments, is to be construed to cover all modifications, alternatives, and equivalents of the embodiments as may fall within the spirit and scope of the disclosure.

One embodiment relates to a protective sports headgear device for water sports, such as water polo. The headgear device may be shaped similar to a conventional water polo cap, but include at least one layer of padded material within the device. For example, one embodiment of a protective sports headgear device may be suitable for wearing on a person's head while that person is engaged in the sport of water polo, wrestling, or other sports. The protective sports headgear device can include an inner covering layer that directly contacts the head of the wearer and an outer covering layer that can be made from a variety of fabrics, including a blend made from polyester and polybutylene terephthalate (PBT). Additionally, the outer covering layer may incorporate decorative designs, team logos, or player numbers.

Embodiments of the protective sports headgear device can further include one or more inner layers of a material or materials that reduce, dampen, or disperse impact forces acting on the head of the wearer. The inner layers may also reduce, dampen or disperse impact forces delivered by the head of the wearer against other individuals. This force reduction, dampening, or dispersion may be accomplished by an inner layer of material that reduces the maximum force felt by the wearer's head during a collision with another body or object. Such material may work by spreading out the applied force over a longer duration than if the collision had taken place without the headgear. Alternatively, this reduction or dispersion of force can be accomplished by a material which spreads the force out over a larger area than if the collision had taken place without the headgear, thereby reducing the maximum pressure asserted on the head at a specific point. This force reduction, dampening, or dispersion can also be accomplished through a rate-dependent, or viscoplastic, material that adapts to different types of impacts.

By reducing, dampening, or dispersing impact forces imparted onto the wearer's head, embodiments of the protective sports headgear device may reduce the risk of head injuries sustained by the wearer. The protective sports headgear device may also reduce the risk of concussions sustained while engaged in various sports by further protecting the wearer's head from various sports traumas. Embodiments may be especially useful in water polo where head injuries are prevalent due to the lack of protective headgear that works efficiently in the water and complies with various rules regarding allowable headgear. Water polo is a sport where heavy or cumbersome headgear is problematic due to the fact that players must constantly support their own weight in the water by treading water. Thus, heavy headgear may weigh a player down, causing the player to have to expend much more energy to stay above water. Further, if headgear is loose-fitting or cumbersome, the headgear can get in the way of the water polo player because the player needs to be able to put their head underwater at times and move underwater with ease. If headgear is loose-fitting or cumbersome, it can create a lot of drag when a player tries to make quick movements in the water. Additionally, a loose-fitting headgear can create a lot of resistance for a player putting their head underwater due to the concave shape of the headgear acting as a parachute of sorts and quickly filling with water. Moreover, traditional protective sports headgear such as helmets may contain parts that are susceptible to corrosion when regularly exposed to water and chlorine.

In some embodiments, the protective sports headgear device may be made to be buoyant so it can float on the surface of the water when not being worn. Traditional water polo headgear is not buoyant and may cause a player to lose their cap during a match if the cap sinks below the water's surface. Embodiments of the protective sports headgear device may be constructed from different buoyant materials which can prevent the headgear from sinking in water. Some embodiments of this protective sports headgear device will balance buoyancy with drag and resistance to entering water. Some embodiments will focus on one characteristic over the others or will try to optimize all characteristics. However, some of these characteristics may not be present or may be de-emphasized in some embodiments.

Figure 2A:
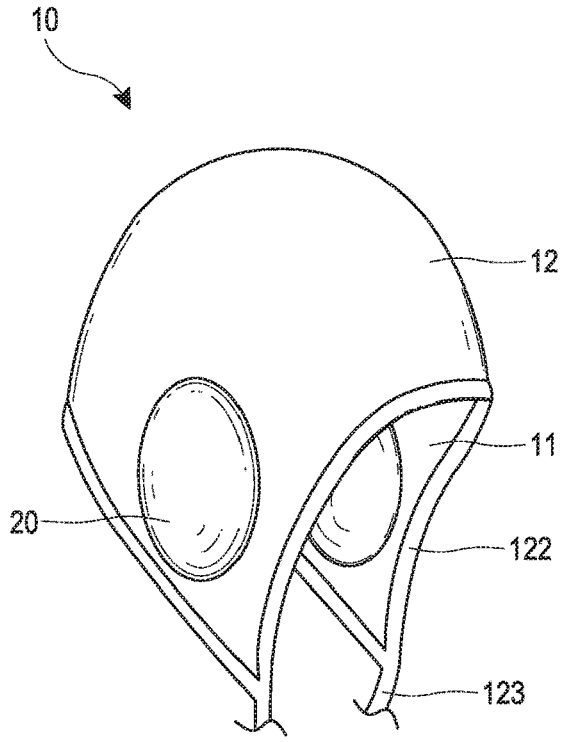
FIG. 2A shows a right-side perspective view of one embodiment of a protective sports headgear device.
Figure 2B:
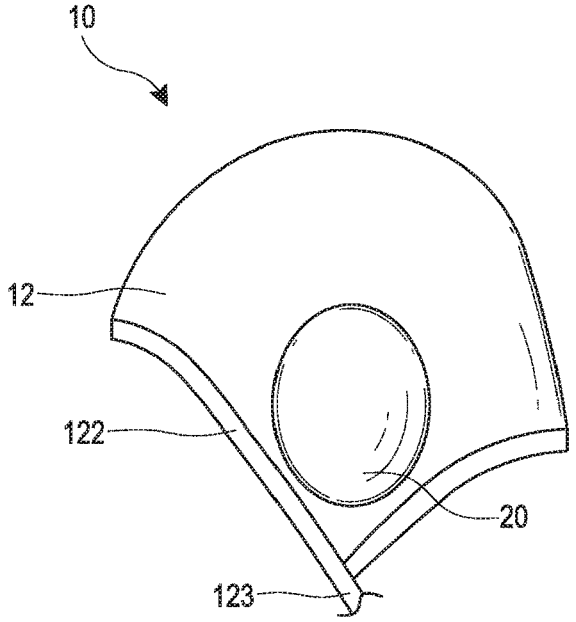
FIG. 2B shows a left-side view of one embodiment of a protective sports headgear device.
Figure 3:
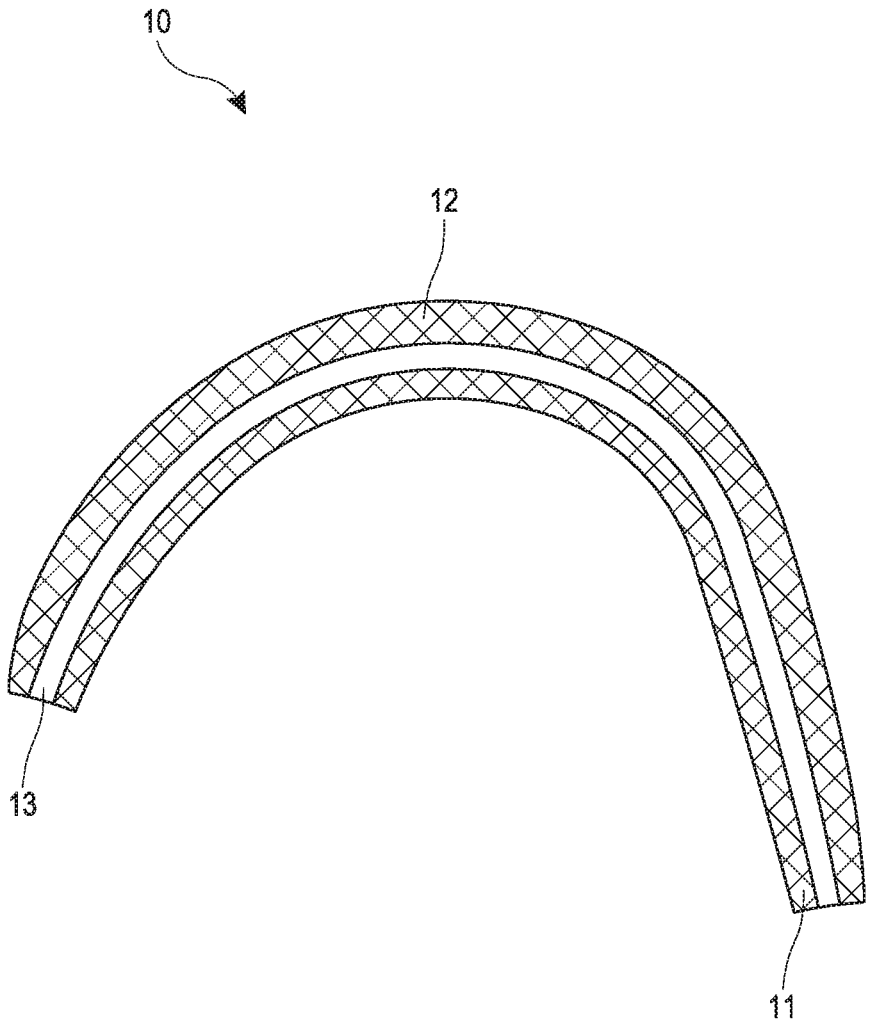
FIG. 3 shows a left-side cross-sectional view of one embodiment of a protective sports headgear device.

FIGS. 1-3 present a protective sports headgear device 10 as it would appear if worn by a user according to certain embodiments. FIG. 1 shows one embodiment of a front, perspective view of a protective sports headgear device 10. As shown, the protective sports headgear device 10 can be separated into at least three general portions, the inner covering material 11, the outer covering material 12, and padding material 13 (FIG. 3) between the covering materials. The inner covering material 11 of the headgear can be disposed on the bottom or inner portion of the protective sports headgear device 10 and can at least partially contact the user's head or hair when in use. The outer covering material 12 can be the top layer of material that is visible on the outside of the protective sports headgear device 10.

The padding material 13 can be disposed somewhere between the outer covering material 12 and the inner covering material 11. However, there can also be embodiments where there is only one of either the outer covering material 12 or the inner covering material 11. In such embodiments, the padding material 13 can be disposed on either side of the covering material and can either be the outer layer or the inner layer. In some embodiments, the protective sports headgear device 10 may cover more of the wearer's forehead region than traditional water polo headgear. This may allow the protective sports headgear device 10 to protect more of the wearer's forehead. This may also help protect other players from injury due to contacting the wearer's forehead.

In one non-limiting embodiment, the outer covering material 12 of the protective sports headgear device 10 will, together with the inner covering material 11, surround and encompass the padding material 13 of the headgear. The outer covering material 12, the inner covering material 11, and the padding material 13 can be formed in a substantially hemispherical shape that generally conforms to the shape of a human head. The outer covering material 12 may be composed of a substantially soft or pliable material in order to mitigate the force applied by the headgear to another body or object in the case of a collision between the head wearing the headgear and a body or object. A person of skill in the art will recognize that the outer covering material 12 of the protective sports headgear device 10 may be made from any number of materials, including but not limited to, polyesters, soft or hard plastic, a rubber, nylon, lycra, neoprene, or some other natural or synthetic material or some combination thereof. In some embodiments, the outer covering material 12 may be made of more resilient materials such as hard plastics or metals. Additionally, a set of ear-guards 20 can be provided on both sides of the headgear. These ear-guards 20 can protect the wearer's ears from trauma caused by elbows, hands, heads, sports balls, or any other type of object or body-part that could otherwise contact the ears if it were not for the ear-guards 20. The ear-guards 20 will be discussed more below with respect to FIGS. 7A-C.

FIGS. 2A-B present side-views of an embodiment of the protective sports headgear device 10. FIG. 2A presents a right-side, perspective view of the protective sports headgear device 10 as it would appear if worn by a user in an embodiment of the invention. The hem 122 is visible and shows where the inner covering material 11 and outer covering material 12 meet. In this embodiment, the inner covering material 11 and outer covering material 12 can be joined together to form an edge or seam. The hem 12 can comprise this edge or seam. Additionally, in certain embodiments, the hem 122 can connect to ties 123 which may extend down from the headgear and allow the wearer to secure the headgear to their head. Some embodiments may not include a hem 122 because the outer covering material 12 may be joined to the inner covering material 11 in some other way such as being bonded. One of skill in the art will appreciate that there are many ways in which one may secure this piece of headgear to their head which include, but are not limited to, ties, Velcro, buckles, straps, etc. The ties 123 may even run from one peripheral side of the protective sports headgear device 10 to the other and thread through the ear-guard 20 on the opposite side. In one embodiment, there may be a sliding buckle on the side of the cap, integrated into the ear-guards 20, or located on one of the ties themselves. The ties 123 may include a clip and buckle similar to the connection pieces on a conventional bicycle helmet. The clip and buckle may be arranged with the clip at the end of one tie and a buckle at the end of the other so that they connect at the bottom. Alternatively, the buckle may be built into the ear guard 20 or attached at some other point on the protective sports headgear device 10. This can allow for a more convenient or comfortable design with less plastic pieces on the ties 123. The ties 123 may also connect to the sides of the protective sports headgear device with Velcro on one or both sides. Thus, in such an embodiment, the user can more easily remove the ties 123 as desired. The ties 123 can also be fixed on both sides with a sliding piece attached in order to adjust the tie length to tighten or loosen the fit. The ties 123 may be made of a more rigid material or fabric so that the ties 123 do not stretch when pulled on. The ties 123 can also have a chin-strap piece. This chin-strap piece may be made of fabric or may be a plastic piece. A plastic chin-strap piece could be concave in shape like a cap such that it can substantially cover the chin. Additionally, there may be embodiments of the protective sports headgear device 10 that do not include ties 123 or some sort of other straps. FIG. 2B presents a left-side view of an embodiment of the headgear.

FIG. 3 presents a cross-sectional view of an embodiment of a protective sports headgear device 10. In this embodiments, the protective sports headgear device 10 can be composed of three layers. The padding material 13 layer can be disposed between the inner covering material 11 layer and the outer covering material 12 layer. In one embodiments, the padding material 13 is made out of a rate-dependent or viscoplastic material that softens impacts. Examples of such materials include Poron-XRD (Rogers Corporation, Rogers, Conn.) or any other type of material that helps to dissipate, dampen, or disperse forces caused by collisions between the head that is wearing the protective sports headgear device 10 and other objects or body-parts. The padding material 13 may reduce the risk of head injuries sustained by the wearer.

The padding material 13 layer may be composed of a substantially smooth surface with a plurality of raised surfaces (not shown) disposed on the smooth surface. These raised surfaces may be similar to small plateaus that are arranged in a pattern over one surface of the padding material 13 layer. The raised pad surfaces can be shaped and arranged to allow the padding material 13 layer, and therefore the protective sports headgear device 10, to more easily flex, bend, fold, stretch, or to conform to the wearer's head. The raised pad surfaces can also be in the form of ridges. Further, the raised pad surfaces can provide for a padding material 13 layer that uses less material but still provides substantially the same protection and cushioning. These raised surfaces or ridges also may not be of the same height as all the other raised surfaces or ridges. Thus, in some embodiments, these raised surfaces or ridges result in a raised surface of variable thickness relative to the substantially smooth surface. In other embodiments, the substantially smooth surface may be replaced with a surface that is not substantially smooth and has valleys or cuts formed in it. Thus, there may be a surface that has both raised ridges formed on it and valleys formed into it. These embodiments can provide for less material in the places that need to flex, bend, fold, stretch, or conform to the wearer's head more without sacrificing too much padding material.

The padding material 13 layer may contain a bladder or other fluid retaining portion so that at least part of the padding material 13 layer can be filled with fluid. This can also be accomplished by having two layers of padding material, where one of those layers is capable of being filled with and retaining a fluid. The fluid-filled padding layer/portion can provide for a better fit by adjusting the amount of fluid in the fluid-filled padding layer or portion. Additionally, the fluid-filled padding layer/portion can provide additional padding that helps to dissipate, dampen, or disperse forces caused by collisions. One of skill in the art will appreciate that the fluid-filled padding layer/portion can be filled with a variety of different gasses and liquids, including but not limited to, air, water, or some other specific liquid or gas or combination of fluids that have desirable properties.

Additionally, any one or multiple of the layers may include a waterproof or protective coating. One of skill in the art will appreciate that this coating may be applied by using a spray, powder coating, paint, or some other application method or combination thereof. The waterproof or protective coating can help prevent corrosion or degradation of any of the materials that may occur due to exposure to water, chlorine, or other chemicals.

In certain embodiments, one or more layers of padding material 13 may be made from a buoyant material. This buoyant material can help the entire headgear to float in water. Thus, if the protective sports headgear device is dislodged during play, it will remain floating in the water so that it can be easily retrieved by a player. The padding material 13 and the covering materials can be formed and cut such that they generally conform to the shape of a human head. One of skill in the art will appreciate that this headgear can be made with many different cuts and dimensions in order to fit various sized heads. FIG. 3 illustrates that these cuts will generally result in the headgear having a concave shape so as to conform to the shape of the top of a head.

Figure 4:
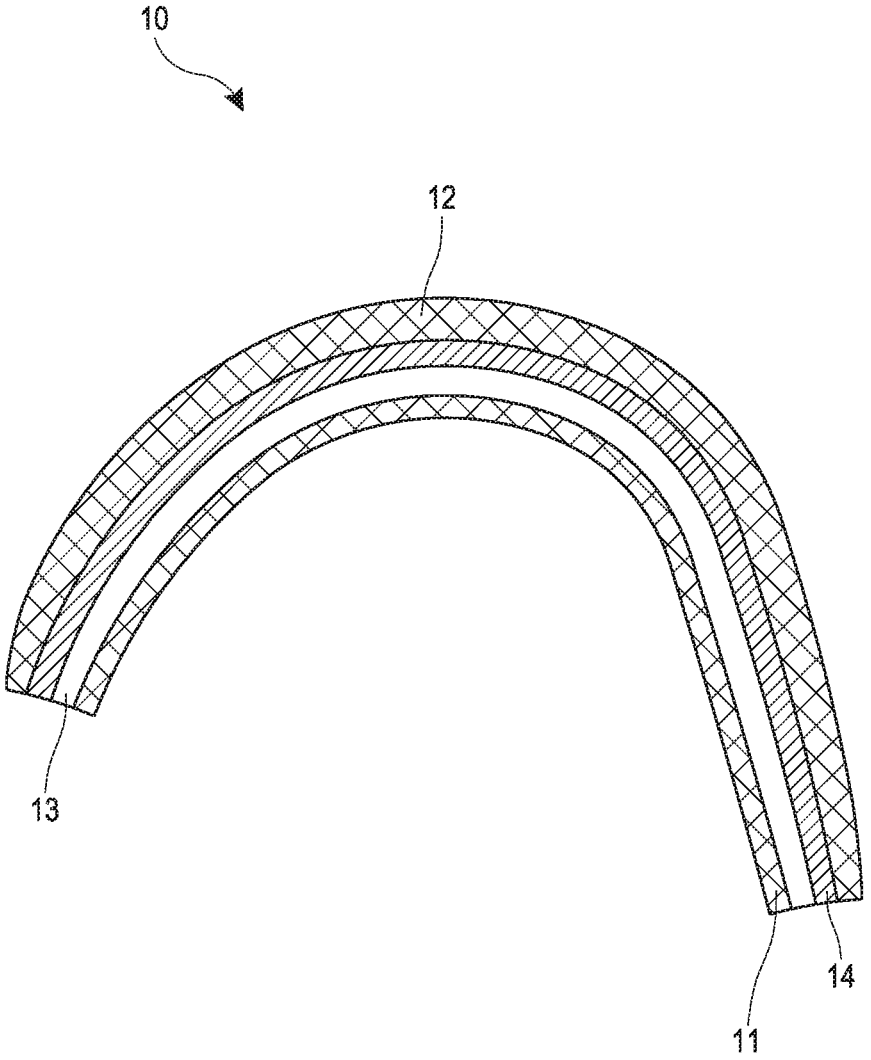
FIG. 4 shows a left-side cross-sectional view of one embodiment of a protective sports headgear device that includes a layer of plastic.

FIG. 4 illustrates a cross-sectional view of an embodiment of the headgear with a layer of plastic 14 disposed between the padding layer and the layer of outer covering material 12. In this embodiment, the protective sports headgear device 10 comprises a layer of plastic 14 disposed between the padding layer and the layer of outer covering material 12. This layer of plastic 14 can made from any type of "hard" plastic such as high density polyethylene (HDPE) or others similar products. One of skill in the art will appreciate that there a variety of plastics can be easily interchanged in this design. The plastic can be rigid and/or flexible. This layer of plastic 14 can be advantageous because it can further help reduce the risk of head injuries sustained by the wearer. The layer of plastic 14 can advantageously help distribute an impact force received by the protective sports headgear device 10 because the impact force would first act upon the rigid plastic 14 which would cause the rigid plastic 14 to act upon the padding layer 13. This would result in the rigid plastic layer 14 transferring the impact force to the padding layer 13 such that the force is more spread out and distributed than if there had been no rigid plastic 13. Additionally, other plastics that are not necessarily rigid may be used as the layer of plastic 14. Although such plastics may not distribute force as well as a rigid plastic, they may be advantageous in other ways.

Additionally, in some embodiments, there may be another layer of padding material 13 disposed between the plastic layer 14 and the outer covering material 12 layer. This additional layer of padding material 13 could provide the added benefit of having additional padding which could additionally reduce an impact force felt by the wearer of the protective sports headgear device 10. Further, layering rigid materials with soft materials can provide for additional and predetermined force-dampening properties. Providing additional layers of padding or material may be used to surround or encapsulate the plastic layer so that is can provide protection for a user, but still be comfortable and safe for sports play.

Figure 5:
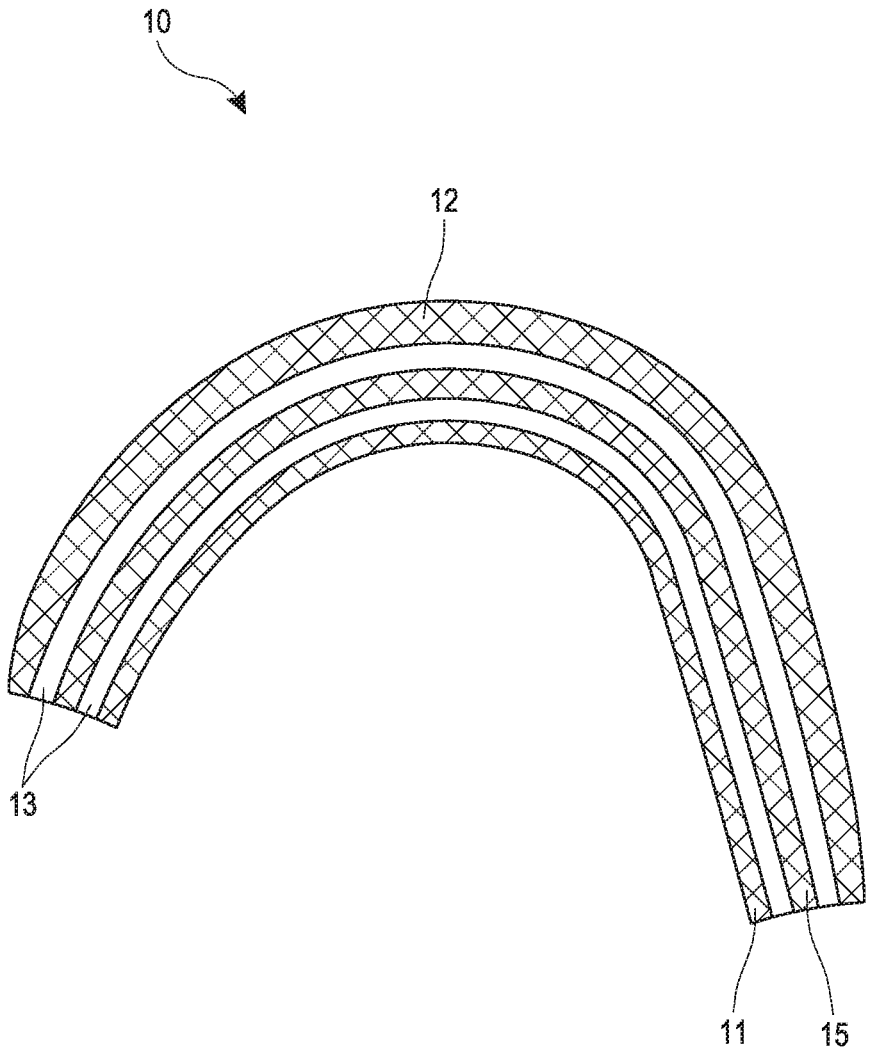
FIG. 5 shows a left-side cross-sectional view of one embodiment of a protective sports headgear device with multiple padding layers.

FIG. 5 illustrates a cross-sectional view of an embodiment of the headgear with multiple layers of padding material 13. By utilizing multiple layers of padding material 13 separated by a layer of some additional material 15, the protective sports headgear device 10 can be adapted to conform to the shape of a person's head. This can further be accomplished by some layers of padding material 13 that are of different shapes than other layers of the padding material 13. In this way, extra layers of padding material 13 can be provided in certain parts of the protective sports headgear device 10 where there is more room or more need for padding material 13. Such a multilayer configuration can provide the benefit of closer-fitting headgear that provides more comfort to the wearer and does not become dislodged. This additional material 15 may be made from the same material as the inner covering material 11 or outer covering material 13 or may be some other material entirely. One of skill in the art will appreciate that this additional material 15 may be chosen from a variety of different materials, including but not limited to, the covering material, fabric, polyester PBT blend, soft plastics, hard plastics, metals, different foam or padding materials, other polymers, fibers or material blends, or some combination thereof. The inside layer of additional material 15 can also be made of a material that is substantially water impermeable. This could be advantageous for preventing water from penetrating to the inside layer of padding material 13 if the outside covering material 12 layer were not waterproof. Additionally, utilizing layers of materials of different rigidity in conjunction with padding can provide advantageous force-dampening properties similar to utilizing a layer of plastic 14 with the padding material 13 as discussed in the previous embodiment.

Figure 6:
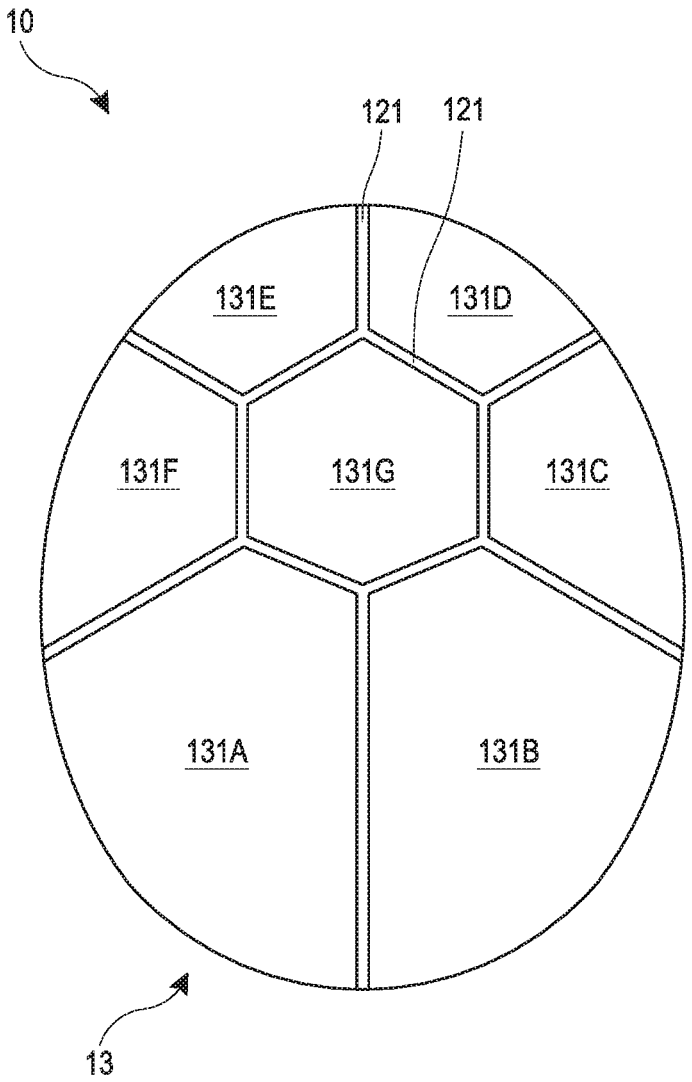
FIG. 6 shows a top-down view of one embodiment of a protective sports headgear device with the outer layer of covering material removed.

FIG. 6 illustrates a top-down view of an embodiment with the outer covering material 12 layer removed so that the padding material 13 layer is visible. In this embodiment, the protective sports headgear device 10 comprises seven padding panels 113A-G where each padding panel 113A-G is joined to at least three other padding panels 113A-G by a joint 121. For example, in this embodiment, padding panel 113A is connected to the two panels 113B,F on either side as well as the hexagonal-shaped top panel 113G. This design provides a protective sports headgear device that can be adapted to the shape of a person's head by creating the multiple joints 121 that allow the padding material 13, and therefore the headgear, to flex in a multitude of ways. Additionally, the protective sports headgear device 10 may incorporate padding material 13 layer designs that use any number of panels to achieve the desired shape for fitting on a head. In other embodiments, some padding panels may be connected to one or two other panels while others may be connected to more than three other panels.

One of skill in the art will appreciate that many different designs incorporating different numbers or configurations of padding panels will be appropriate to fit different sizes and shapes of heads. In certain embodiments, the protective sports headgear device 10 may be specifically tailored to fit one person's head or a small group of people's heads which may require a much more specific design that does not need to be as adaptable. On the other hand, it may be advantageous to have a protective sports headgear device 10 that can fit over as broad a range of heads as possible, in which case, the padding panel design of the protective sports headgear device 10 would need to be highly adaptable. Furthermore, it may be advantageous to use a padding panel configuration such that the protective sports headgear device 10 could be used by dogs or pets to reduce the risk of head injury. It may also be advantageous to form the padding 13 layer for the protective sports headgear device 10 out of a small number of panels or even a singular piece of padding for ease of manufacturing or to reduce costs associated with production. In certain embodiments, the protective sports headgear device 10 comprises a small number of panels or single panel of padding where those padding panels are themselves formed to match the shape of a person's head through 3d-printing or some other automated method of forming padding panel shapes that are more specialized than cutting shapes from a sheet of padding. Additionally, for each number of panels, there can be a variety of different corresponding designs. For example, although FIG. 6 depicts a seven-panel design, there can be many other different designs that incorporate seven padding panels.

The joints 121 can use a variety of different types of connectors, including but not limited to, stitching, adhesive, elastic connections, rigid connections, bonding, liquid seams, any combination thereof, or any other method of joining two materials. The joints 121 function as connections between the padding panels 113A-G. The joints 121 can be flexible, or the joints can also be rigid to provide more structure and support for the protective sports headgear device 10.

Although FIG. 6 illustrates an embodiment with no outer covering material layer, the protective sports headgear device 10 may appear similar when viewed with the outer covering material layer on. That is to say that the outer covering material layer may show the same joint 121 lines as the padding material 13 layer below it. The outer covering layer may have joints 121 in it as well. These joints 121 may run completely through the protective sports headgear device 10 and connect multiple separate headgear panels. In other words, the joints 121 may connect not just the padding material layer but also any other layers of the protective sports headgear device 10 that are present such as the inner covering material layer and/or the outer covering material layer. Additionally, the joints on the outside of the protective sports headgear device could be in the form of plastic ribs. These plastic rib joints 121 could give the protective sports headgear device 10 additional structural support. In certain embodiments, the padding panels 113 may be separated by seams or stitching that bind the inner covering material 11 to the outer covering material between the padding panels 113A-G.

The protective sports headgear device 10 can be created through a method of manufacturing that involves creating a layer of padding material from individual padding panels and connecting those panels by joints. This method of manufacturing the protective sports headgear device can allow for a manufacturing process that is more adaptable than other manufacturing processes. In this way, many different sizes and shapes of protective sports headgear devices can be created without as much lost time or extra costs as would be associated with other methods of manufacturing.

Figure 7A:
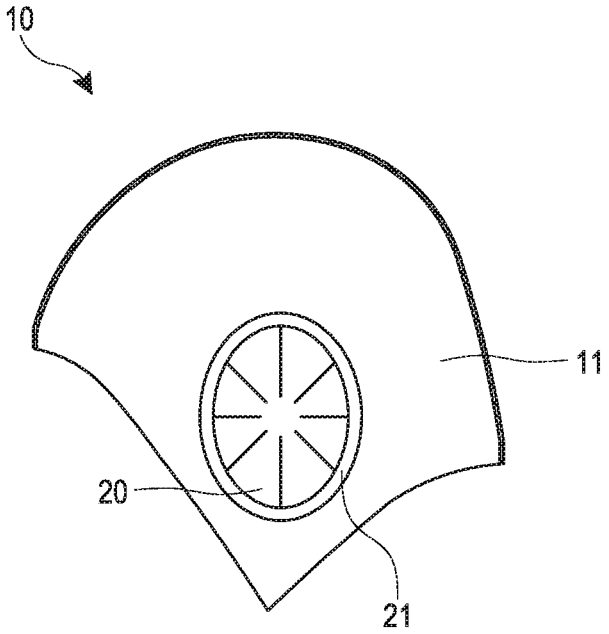
FIG. 7A shows a left-side cut-away view of one embodiment of a protective sports headgear device with padding on the inside of the ear-guard.
Figure 7B:
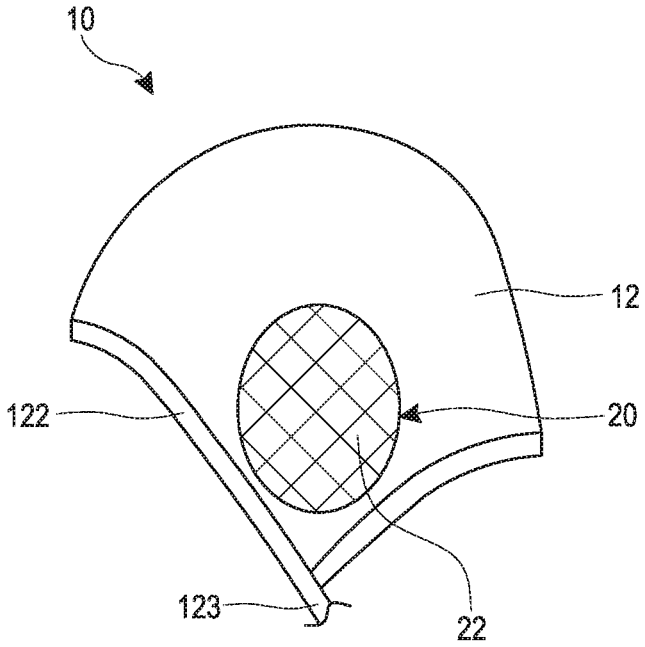
FIG. 7B shows a left-side view of one embodiment of a protective sports headgear device with an ear-guard with padding on the outside.
Figure 7C:
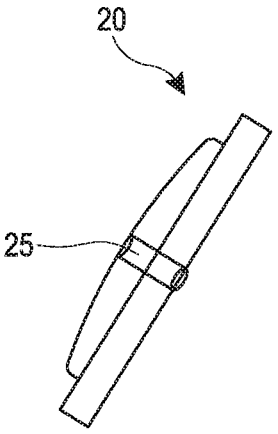
FIG. 7C shows a cross-sectional view of one embodiment of an ear guard for a protective sports headgear device.

In certain embodiments, the protective sports headgear device comprises ear-guards 20. FIG. 7A-C illustrate non-limiting embodiments of ear-guards 20 for a protective sports headgear device 10. As shown, the ear-guards 20 include an inner padding 21. FIG. 7A shows a left-side, cut-away view of an embodiment of the protective sports headgear device with ear-guards 20 which include inner padding 21 for where the ear-guard 20 contacts the wearer's head when in use. The ear-guard inner padding 21 advantageously helps protect the head, and especially the area around the ear, from trauma caused by an impact sustained at least partially by the ear guard 20. This ear-guard inner padding 21 may be made of materials that reduce, dampen, or dissipate impact force such as Poron-XRD or many other types of padding materials that may be more comfortable or economic than Poron-XRD. The ear-guard inner padding 21 may also add buoyancy to the protective sports headgear device 10. The ear-guard inner padding 21 may provide enough buoyancy to prevent the protective sports headgear from sinking if the rest of the protective sports headgear device 10 is not buoyant in and of itself. Alternatively, the ear-guard padding 21 may merely supplement the buoyancy of the protective sports headgear device 10 to make it more buoyant.

FIG. 7B shows a left-side view of an embodiment of the protective sports headgear device 10 with ear-guards 20 which are composed of an outer layer of padding 22. This embodiment is advantageous because padded ear-guards 20 can dampen, dissipate, or reduce impacts to the ear of the wearer. In this way, the padded ear-guards 20 may reduce the risk of ear injuries sustained by the wearer. Additionally, this padding reduces the risk of injuries sustained by other people or objects that may come into contact with the ear-guards 20 of the protective sports headgear device 10. The padded ear-guards 20 may be composed entirely of padding or may have an outer-layer of padding 22 formed over a rigid frame. Additionally, the ear-guard outer padding 22 may be made of a material that allows sound to penetrate so that the wearer may still substantially hear the sounds of their surroundings or communications from others. This may be accomplished by using a substantially porous or foam-like ear-guard outer padding 22 in order to allow sound-penetration. Additionally, the ear-guard outer padding 22 may have large gaps in it to provide for even more sound-penetration.

FIG. 7C shows a cross-sectional view of an embodiment of an ear-guard 20 of a protective sports headgear device 10. This ear-guard 20 configuration can comprise multiple layers of padding stacked on top of each other with an ear-guard hole 25 running through the middle. This configuration may allow for extra padding while at the same time allowing sound to penetrate to the wearer's ears. This can be accomplished by providing an avenue for sound-penetration directly to the ears shown as ear-guard hole 25 in FIG. 7C. A person of skill in the art will appreciate that although the figure depicts only two padding layers, three, four, or more layers of padding may be used in this configuration. As discussed above, layering of padding can provide additional benefits in terms of force dissipation and dampening.

Figure 8:
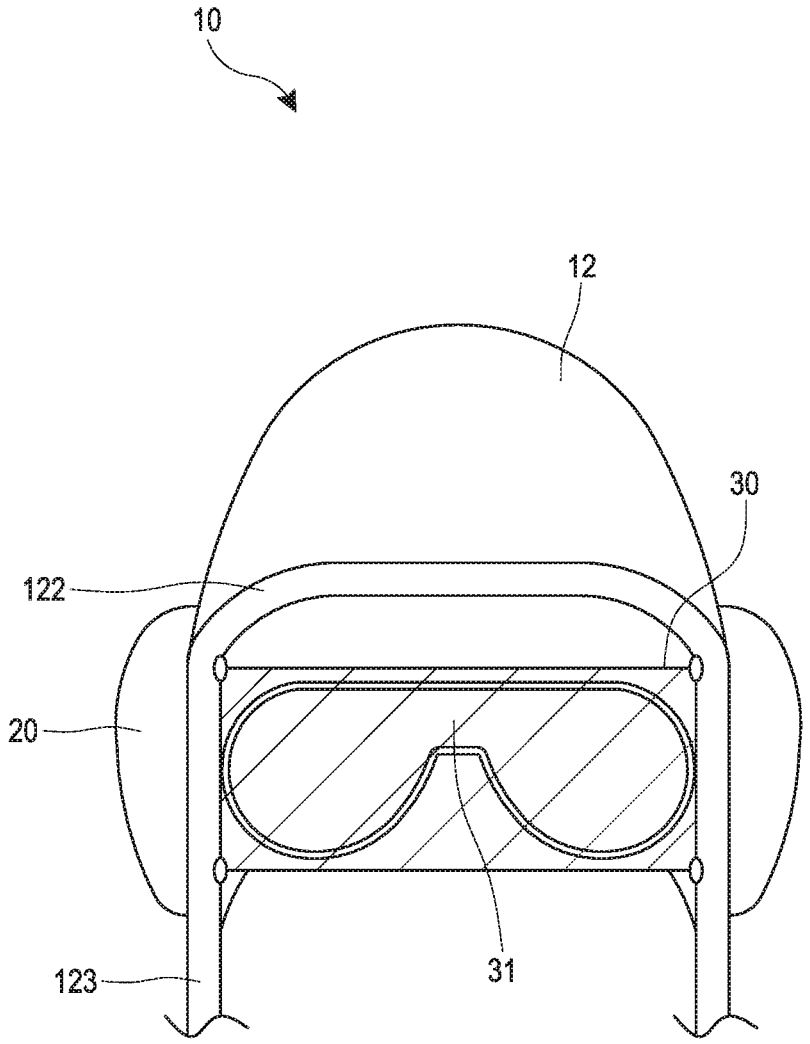
FIG. 8 shows a front perspective view of one embodiment of a protective sports headgear device that includes a face-mask and goggles.

FIG. 8 illustrates an embodiment of a protective sports headgear device 10 that includes a facemask 30 and/or goggles 31. Embodiments of the protective sports headgear device 10 that include a facemask 30, can protect the wearer's face and eyes from collisions with other body-parts or objects such as a water polo ball. The nose is an especially vulnerable part of the face and is particularly susceptible to being broken by a water polo ball. The facemask 30 can extend from one peripheral edge of the front portion of the headgear to the other. In that configuration, the facemask 30 could attach to the hem 122 that connects the outer covering material 12 layer to the inner covering material 11 layer or to somewhere nearby the hem 122. The facemask 30 may also connect to the rest of the headgear at a location substantially close to the ear-guards 20 on each side. The facemask 30 may also be detachably connected to the protective sports headgear device 10. One of skill in the art will appreciate that there are many ways in which the facemask 30 could detachably connect to the protective sports headgear device 10, including but not limited to, buttons, buckles, magnets, Velcro, glue, or some other sort of mechanical, chemical, or other connection means or some combination thereof.

An embodiment of a protective sports headgear device 10 that includes goggles 31 is advantageous because goggles 31 can protect the wearer's eyes. Goggles 31 can further provide protection from the harmful rays of the sun as well as provide prescription vision correction where it is otherwise impractical to wear glasses, such as while playing water polo. This inventive design provides a way for the wearer to wear goggles 31 as part of their protective sports headgear without having to worry about the goggles 31 slipping or falling off and sinking to the bottom of the pool. The goggles 31 may be secured to the protective sports headgear device 10 through many different ways, including but not limited to, clips, Velcro, fasteners, buckles, buttons, slots formed in the peripheral sides of the protective sports headgear device 10, or slots formed in the ear-guards 20, or any combination thereof or a variety of other ways. Additionally, the protective sports headgear device 10 can include one, both, or neither of the facemask 30 or goggles 31.

In embodiments where the padding material is not made from a buoyant material, other parts of the protective sports headgear device may be made from a buoyant material such as the covering materials, the ear guards, the ties, the joints, or the hem. In embodiments where the ties are buoyant but the rest of the protective sports headgear device does not float, the ties can remain above the surface while the rest of the protective sports headgear device acts as an anchor. Additionally, in embodiments where neither the protective sports headgear device nor the ties are made out of a buoyant material, buoyant attachments may be added to the ties. These attachments can aid players in visually locating dislodged protective sports headgear devices and could be similar to fishing bobbers. In these embodiments, the protective sports headgear device may not be as susceptible to being pulled into a gutter in a pool by water currents while still being able to be seen and retrieved by the players.

In other embodiments where the protective sports headgear device does float, there may be attachments added to the ties that are dense enough to be substantially not buoyant and act as anchors for the ties. These anchors can help prevent the protective sports headgear device from being pulled into a gutter in a pool by water currents while the protective sports headgear device is still able to float and therefore be seen and retrieved by the players. In many of these embodiments, the protective sports headgear device can also resist being pulled into a gutter by water currents due to its convex shape combined with the ties/attachments helping to keep a substantially open shape about the headgear. This open convex shape can act to resist movement through water, where for example, there is a current pulling the ties/attachments but not affecting the rest of the protective sports headgear device in the same way.

A person of skill in the art will recognize that the buoyant materials herein could encompass many different materials, including but not limited to, EVA foams, polyethylene foams, polyurethane foams, urethane foams, polystyrene, other closed-cell structure foams, and other materials, polymers or composites, or a combination thereof. Additionally, the term buoyant material can also be used to describe combinations of materials or layers or portions of materials that together achieve buoyancy. For example, although a certain plastic may not be buoyant itself, when it is formed as a pocket that is filled with air, the pocket may then become buoyant. Thus, for simplicity, the term buoyant material may be used to describe combinations of materials or layers or portions of materials such as this pocket.

Figure 9:
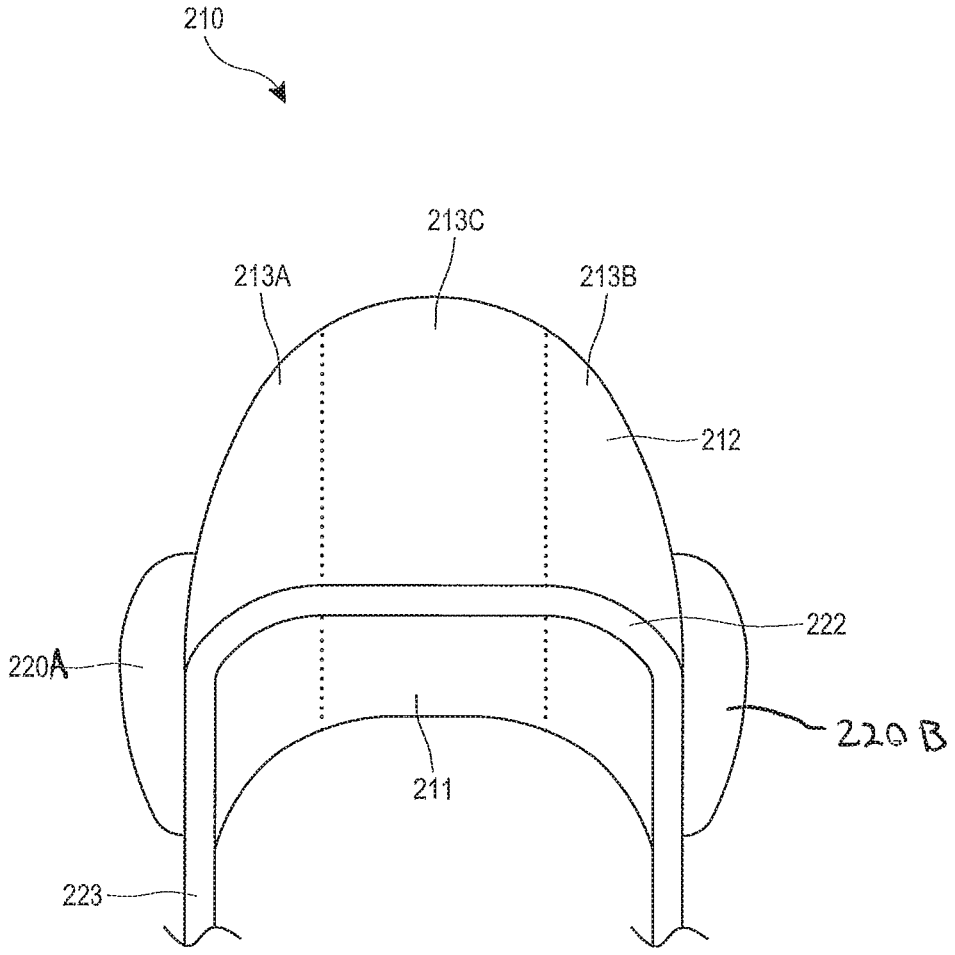
FIG. 9 shows a front perspective view of an alternative protective sports headgear device having multiple padding panels.
Figure 10A:
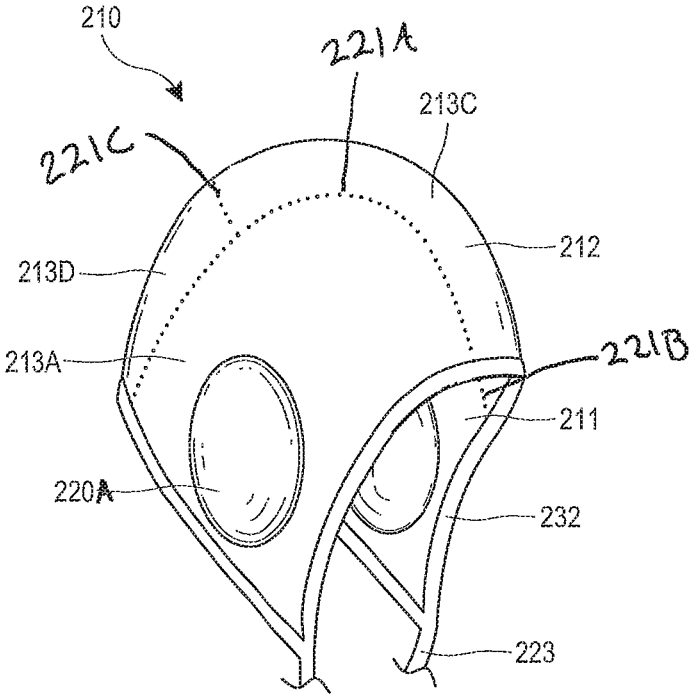
FIG. 10A shows the right side, prospective view of the alternative protective sports headgear device according to certain embodiments having multiple padding panels.
Figure 10B:
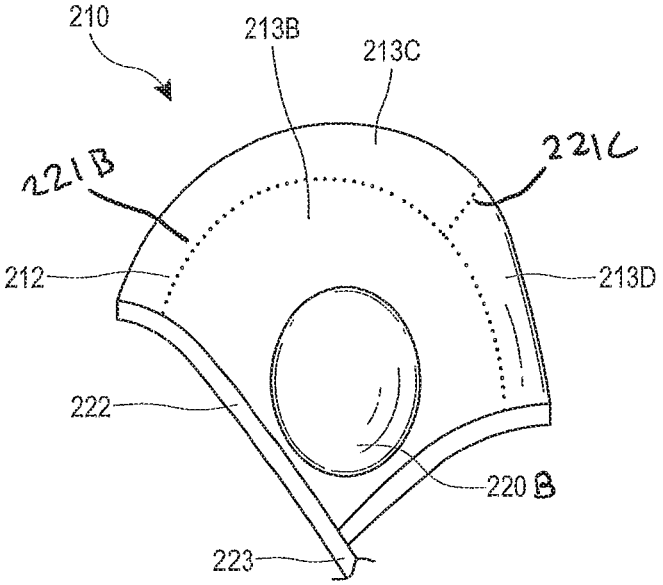
FIG. 10B shows the left side of an alternative protective sports headgear device according to certain embodiments having multiple padding panels.
Figure 11:
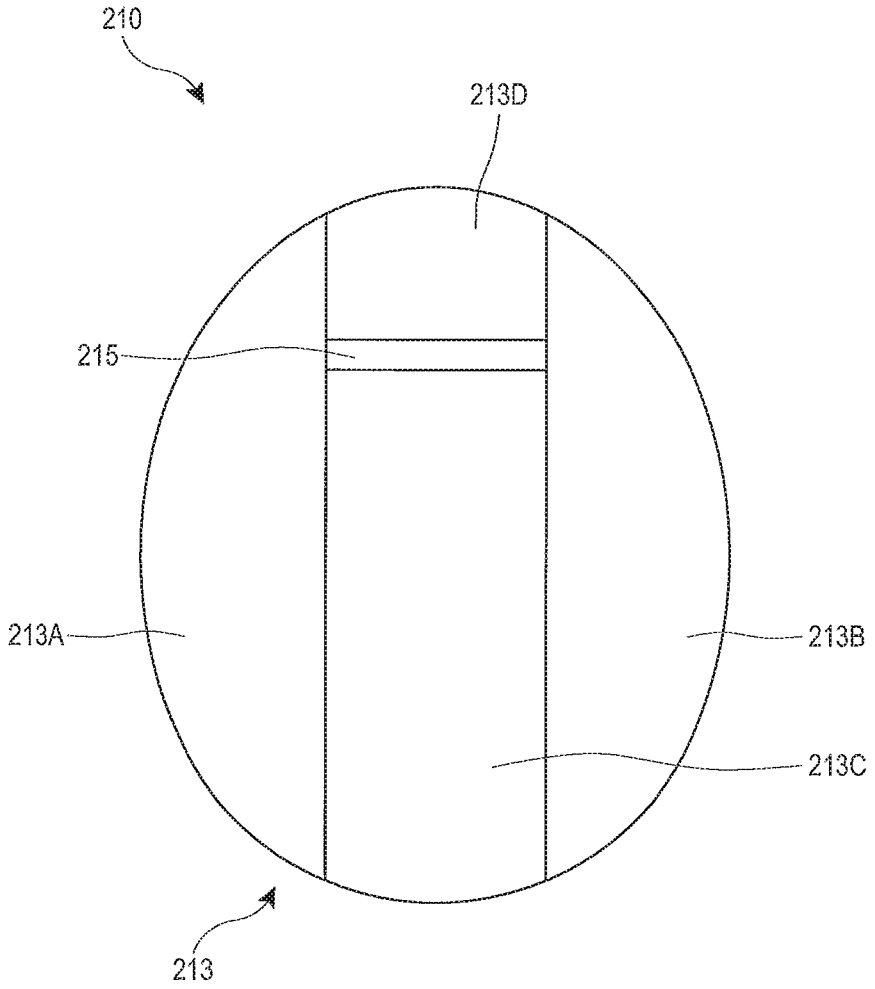
FIG. 11 shows a top-down view of an alternate protective sports headgear device according to certain embodiments having multiple padding panels with the outer covering material removed.

FIGS. 9-11 illustrate an embodiment of a padded protective sports headgear device 210 that includes four padded panels 213A-D. FIG. 9 is a front, perspective view of the protective sports headgear device 210. The headgear device 210 can be separated into at least three general layers. The first layer includes an inner covering material 211 that faces the head of the user. The second layer includes the outer covering material 212 that faces the external environment, and the third layer is an interior padding material 213 that is disposed between the covering materials 211 and 212. As shown, a set of ear-guards 220A,B are provided on the right and left sides of the headgear. Running along the edge of the headgear device 210 is a hem 222 that is visible and shows where the inner covering material 211 and outer covering material 212 meet. In certain embodiments, the inner covering material 211 and outer covering material 212 are joined together to form the hem 222. Additionally, in certain embodiments, the hem 222 can extent downward from the headgear device 210 to form ties 223 to allow the wearer to secure the headgear device 210 to their head.

As shown in FIGS. 10A and 10B, the headgear device 210 includes four padding panels 213A-D that may be separated from one another by seams 221A, 221B and 221C. The seams 221A, 221B and 221C bind the inner covering material 211 to the outer covering material 212 between the interiorly located padding panels 213A-D. These seams maintain the padding panels 213A-D in place within pouches formed within the headgear device 210 for each of the individual padding panels 213A-D. As shown, the seam 221C runs horizontally across the crown of the user's head. Located around the seam 221C is a gap 215 that allows the padding panels 213D and 213C to move with respect to one another. This is shown more completely with respect to FIG. 11 below.

FIG. 11 illustrates the top-down view of the protection device 210, with the covering layer 212 removed to expose the four padding panels 213A-D. The right padding panel 213A is on the right side, the left padding panel 213B is on the left side, and the two center padding panels 213C & D are shown running front to back across the crown of a user. The first center padding panel 213C is shown as disposed toward the front of the head while the second center padding panel 213D is shown as disposed towards the back of the head. In this embodiment, the first center padding panel 213C spans from the forehead area to approximately the crown of the wearer's head. The second center padding panel 213D spans from approximately the crown of the wearer's head to about the neck of the user where the protective sports headgear device 210 ends.

It should be understood that this arrangement of pads is not the only possible arrangement, and that the padding panels 213C and 213D can begin or end either closer to the anterior or posterior of the device in other embodiments. For instance, the right panel 213A can substantially cover the right side of a person's head, or the left panel 213B can substantially cover the left side of a person's head. In certain embodiments, the first center panel 213C can substantially cover the top, anterior portion of a person's head. In certain embodiments, the second center panel 213D can substantially cover the top, posterior portion of a person's head.

In certain embodiments, the protective sports headgear device 210 comprises the gap 215 disposed between the first center padding panel 213C and the second center padding panel 213C. In certain embodiments, the gap 215 acts as a shape accommodation portion that can expand, contract, or otherwise shift or transform in order to allow the headgear device 210 to accommodate heads of different shapes and sizes. The gap 215 can be a space or opening between padding panels. In some embodiments, the gap 215 does not comprise a gap in fabric or covering materials. That is to say, in certain embodiments, there may be covering material or fabric surrounding the gap 215. The gap 215 can allow the padding panels 213C and/or 213D to move in relation to one another. For example, the gap 215 may allow the padding panel 213D to move backwards and/or upwards to accommodate the shape of the wearer's head. In certain embodiments, the gap 215 allows padding panel 213D to move backwards and/or upwards to accommodate long-hair that is held behind the head. The gap 215 can allow the protective sports headgear device 210 to accommodate long-hair that is held in a swim cap at the back and/or top of the wearer's head. The gap 215 can allow the protective sports headgear device 210 to accommodate a variety of shapes of heads. In certain embodiments, the gap 215 can increase in size when the wearer puts the protective sports headgear device 210 on their head. In certain embodiments, the fabric surrounding the padding pieces 213A-D can stretch to allow the padding pieces 213A-D to move in relation to each other.

ALTERNATE EMBODIMENTS

In an alternate embodiment, the gap may be a shape accommodation portion that is filled with an elastic material. In this embodiment the back end of the first center padding panel is connected to the front end of the second center padding panel through a stretchable or elastomeric material that allows the two center padding panels to move in relation to one another. In certain embodiments, the elastic material may allow the first center padding panel to move backwards and/or upwards to accommodate the shape of the wearer's head. In certain embodiments, the substantially elastic material allows the second center padding panel to move backwards and/or upwards to accommodate long-hair that is held behind the head. The substantially elastic material can allow the protective sports headgear device to accommodate long-hair that is held in a swim cap at the back and/or top of the wearer's head by stretching over the bulk caused by the hair. In certain embodiments, the substantially elastic material can increase in a length or width dimension when the wearer puts the protective sports headgear device on their head. In certain embodiments, the fabric surrounding the padding pieces may also stretch to allow the padding pieces to move in relation to each other.

In another embodiment, the shape accommodation portion can comprise an overlap between the first and second center padding panels. In this embodiment, a portion of the back of first center padding panel can overlap a portion of the second center padding panel. Alternatively, a portion of the front of the second center padding panel can overlap a portion of the first center padding panel. This overlap can allow the padding panels to move relative to one another when the wearer places the protective sports headgear device on their head. The overlap between the center padding panels can allow the protective sports headgear device to stretch and expand to accommodate for various head/hair sizes and shapes. The overlap can allow the headgear device to stretch and expand with minimal to no gap between padding panels. In this way, the overlap between the center padding panels can provide increased protection.

In another alternate embodiment, the protective sports headgear device comprises a hole or aperture in the accommodation portion that allows the wearer to put their hair through the hole. In this way, the hole or aperture can allow the protective sports headgear device to accommodate wearers with long hair. The hole or aperture can also allow the protective sports headgear device to expand or contract in certain directions to accommodate different sized heads. In certain embodiments, the headgear device comprises multiple holes or apertures. The multiple holes or apertures can allow the protective sports headgear device to expand or contract in certain directions to accommodate different sized heads. The multiple holes or apertures can also allow for venting or air flow through the protective sports headgear device.

In still another embodiment, the protective sports headgear device can comprise removable and/or replaceable padding panels. In some embodiments, the hem of the protective sports headgear device comprises at least one separable portion, which can be separated by the wearer with a reasonable amount ease. This separable portion can comprise Velcro, hooks and loops, snaps, or some other means of fastening two fabrics together. A user can separate this separable portion such that there is a portion of the outer covering material that is not connected to the inner covering material. In certain embodiments, the stitching between panels can comprise at least some separable portion which can be separated by the wearer with a reasonable amount ease. This separable portion can comprise Velcro, hooks and loops, snaps, or some other fastening component or components. A user can separate this separable portion such that there is a portion of the outer covering material that is not connected to the inner covering material. In certain embodiments, the protective sports headgear device can comprise a pouch. The pouch can be a pouch formed by the inner covering material and outer covering material. The pouch can be made to receive one or more padding panels. In certain embodiments, replaceable padding panels can be inserted into the protective sports headgear device through an opening made by separating a separable portion between the outer covering material and the inner covering material.

In certain embodiments, the accommodation portion can comprise a hole or aperture. In certain embodiments, the protective sports headgear device comprises three padding panels. In certain embodiments with three padding panels, the first padding panel can substantially cover the right side of a person's head, the second padding panel can substantially cover the left side of a person's head, and the third padding panel can substantially cover the top-center and back-center of a person's head. In certain embodiments with three padding panels, the third padding panel can comprise an expandable portion. The expandable portion can be capable of expanding, straightening out, or stretching when the user puts the protective sports headgear device on their head. In certain embodiments, the expandable portion can comprise an accordion or zig-zag shaped portion of padding material. In certain embodiments, the expandable portion can allow the third padding panel to stretch to accommodate the shape of a person's head and/or their hair. In certain embodiments with three padding panels, the protective sports headgear device can comprise a hole or aperture. In certain embodiments with three padding panels, the protective sports headgear device can comprise removable and/or replaceable padding panels. In certain embodiments with three padding panels, the protective sports headgear device can comprise substantially elastic portions.

In certain embodiments, the protective sports headgear device 210 can comprise any of the features or combinations of features described above for embodiments of the protective sports headgear device 10 that do not have the specific configuration of three or four padding panels as described in connection with the protective sports headgear device 210. For example, the protective sports headgear device 210 can comprise features or combinations of features including, but not limited to, a facemask, goggles, padding material comprising Poron-XRD, padding material with a plurality of raised surfaces or ridges, padding material layer that includes a bladder, waterproof or protective coatings, buoyant padding material, multiple padding material layers, a hard plastic padding material layer, or joints that connect padding panels.

In certain embodiments, the protective sports headgear device 210 can comprise designs, pictures, logos, words, numbers, or other ornamentations, decorations or designations. In certain embodiments, these ornamentations, decorations or designations can be applied to or integrated into the outer covering material. For example, this could be accomplished through methods including, but not limited to, dye sublimation, silk-screening, or other similar processes. In certain embodiments, these ornamentations, decorations or designations can be integrated into the protective sports headgear device 210 in another way. For example, the protective sports headgear device 210 could comprise a design underneath the outer covering material such that it were visible through the outer covering material. This could allow for materials to be used that could otherwise be degraded by sunlight and/or chlorine if it were on the outside of the protective sports headgear device 210.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A protective sports headgear device for waterpolo comprising:

a rigid right ear guard and a rigid left ear guard;

an inner layer of material comprising a first side configured to contact a wearer's head and a second side which contacts at least four padding panels;

an outer layer of material having an internal side which contacts the at least four padding panels and an external side that provides the outer surface of the headgear device;

a plurality of seams connecting the inner layer of material to the outer layer of material and forming at least four pouches retaining the at least four padding panels; and wherein, the at least four padding panels comprise a first rectangular padding panel configured to be disposed over the top and crown of the wearer's head, a second rectangular padding panel configured to be disposed over the crown and rear of the wearer's head, a third padding panel configured to be disposed on the left side of the wearer's head, and a fourth padding panel configured to be disposed on the right side of the wearer's head, wherein the third and fourth padding panels are shaped to partially surround the rigid right and left ear guards, and a shape accommodation portion comprising a portion of the outer layer, and none of the padding panels, the shape accommodation portion configured to be located at the crown of the wearer's head and between the first and second rectangular padding panels and configured to expand when the headgear device is placed on a wearer's head.

2. The device of claim 1, wherein the shape accommodation portion comprises a space or opening between the first and second rectangular padding panels.

3. The device of claim 1, wherein the shape accommodation portion comprises an elastic material.

4. The device of claim 1, wherein the device comprises four padding panels and four pouches and the first rectangular padding panel is disposed in a first pouch, which is disposed on a medial and anterior portion of the protective sports headgear, and wherein the second rectangular padding panel is disposed in a second pouch, which is disposed on a medial and posterior portion of the protective sports headgear.

5. The device of claim 4, wherein the first pouch includes the anterior-most portion of the headgear and is configured to overlie a crown of a wearer's head when the device is worn, and wherein the second pouch includes the posterior-most portion of the headgear and is configured to overlie the crown of the wearer's head when the device is worn.

6. The device of claim 1, wherein the at least four padding panels are configured to freely move within the at least four pouches.

7. The device of claim 1, wherein the plurality of seams comprises a first lateral seam and a second lateral seam wherein the shape accommodation portion is positioned between the first lateral seam and the second lateral seam.

8. The device of claim 1, wherein the plurality of seams are formed from stitching, adhesive, an elastic connection, or rigid connectors.

9. The device of claim 1, wherein the at least one layer of the padding panels is made of a rate-dependent material.

10. The device of claim 9, wherein the rate-dependent material is a microcellular open cell urethane foam.

11. The device of claim 1, wherein at least one of the inner covering material or outer covering material is made from a blend of polyester and polybutylene terephthalate (PBT).

12. The device of claim 1, further comprising a facemask configured to cover the eyes and face of the wearer of the protective sports headgear.

13. The device of claim 1, further comprising goggles configured to cover the eyes of the wearer of the protective sports headgear device.

14. The device of claim 1, further comprising an edge that joins the inner layer to the outer layer such that the at least four padding panels are retained within the inner layer and outer layer material.

15. The device of claim 14, wherein the edge is composed of a buoyant material.

16. The device of claim 14, further comprising ties that extend downward from the edge on each peripheral side of the protective sports headgear device.

17. A method of manufacturing a protective sports headgear device, comprising providing a plurality of padding panels, comprising a first rectangular padding panel configured to be disposed over the top and crown of the wearer's head, a second rectangular padding panel configured to be disposed over the crown and rear of the wearer's head, a third padding panel configured to be disposed on the left side of the wearer's head, and a fourth padding panel configured to be disposed on the right side of the wearer's head;

providing an inner layer of material and an outer layer of material shaped to fit a wearer's head, wherein a plurality of pouches are formed from the inner and outer layers and the pouches are separated from one another by seams;

providing rigid right and left ear guards, wherein the third and fourth padding panels are shaped to partially surround the rigid right and left ear guards;

inserting the padding panels into the plurality of pouches;

joining the edges of the inner and outer layers such that the padding panels are retained within the pouches;

forming at least one shape accommodation portion disposed between a first rectangular padding panel positioned to cover a forehead and portion of a crown of the wearer's head and a second rectangular padding panel positioned to cover another portion of the crown and back of the wearer's head, the shape accommodation portion comprising a portion of the outer layer and none of the padding panels, and the shape accommodation portion configured to expand when placed on a wearer's head; and attaching the right ear guard to a right side of the device, and attaching the left ear guard to a left side of the device.

* * * * *